US006676769B2

(12) United States Patent
Kao et al.

(10) Patent No.: US 6,676,769 B2
(45) Date of Patent: Jan. 13, 2004

(54) APPARATUS AND METHOD FOR CLEANING A FURNACE TORCH

(75) Inventors: June-Yie Kao, Shi-Kan (TW); Yie-Min Wu, Shi-Kan (TW); Ming-Hsun Yang, Tainan (TW); Chii-Shing Yang, Chao Tao Village (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 231 days.

(21) Appl. No.: 09/993,238

(22) Filed: Nov. 6, 2001

(65) Prior Publication Data

US 2003/0084923 A1 May 8, 2003

(51) Int. Cl.[7] ..... B08B 9/00

(52) U.S. Cl. ..... 134/23; 134/2; 134/3; 134/22.1; 134/22.17; 134/32; 134/34; 134/41; 134/117; 134/135; 134/137; 134/157; 134/166 R; 134/170; 248/689; 248/693; 248/560; 248/94; 248/317; 211/60.1; 211/71.01; 211/78; 438/905

(58) Field of Search ..... 134/2, 3, 22.1, 134/22.17, 23, 32, 34, 41, 137, 117, 135, 157, 166 R, 170; 248/689, 693, 560, 94, 317; 211/60.1, 71.01, 78; 438/905

(56) References Cited

U.S. PATENT DOCUMENTS 4,529,093 A * 7/1985 Ruiz ..... 211/59.2
5,988,190 A * 11/1999 Borges ..... 134/117

FOREIGN PATENT DOCUMENTS

DE 2511008 * 9/1976

* cited by examiner

*Primary Examiner*—Randy Gulakowski
*Assistant Examiner*—M. Kornakov
(74) *Attorney, Agent, or Firm*—Tung & Associates

(57) ABSTRACT

An apparatus and a method for cleaning a torch for a vertical furnace used in semiconductor processing are disclosed. The apparatus is constructed by two main components of a basket-shaped fixture body and a cleaning bath. The fixture body is formed of cylindrical shape with a top ring, a bottom ring and three support rods connecting the two rings together. The top ring is provided with an outwardly extending flange portion for engaging an opening in a cleaning bath for supporting and suspending the fixture body in the bath. The bottom ring is equipped with a pair of symmetrically positioned, inwardly extending arcuate-shaped flange portions adapted for supporting an edge of a bottom surface of the furnace torch in the cleaning bath.

13 Claims, 1 Drawing Sheet

APPARATUS AND METHOD FOR CLEANING A FURNACE TORCH

FIELD OF THE INVENTION

The present invention generally relates to an apparatus and a method for cleaning a furnace torch and more particularly, relates to an apparatus and a method for cleaning an external torch for a vertical furnace used in semiconductor processing by utilizing a specially designed fixture for supporting the torch during cleaning.

BACKGROUND OF THE INVENTION

In connection with processes used to manufacture semiconductor devices, such as integrated circuits, numerous process steps are carried out in a controlled environment at elevated temperatures. Such processes includes oxidation, diffusion, chemical vapor deposition and annealing. In order to realize elevated processing temperatures, semiconductor wafers are processed in an evacuated chamber, typically in a form of a quartz tube which is housed within a semiconductor furnace.

The most common type of semiconductor furnace is of the so-called "hot wall" electric type which facilitates batch processing of semiconductor wafers. Furthermore, hot wall electric furnaces exhibit excellent temperature stability and precise temperature control. Modern hot wall diffusion furnaces are capable of controlling temperatures over the range of 300°–1200° C. to an accuracy of ±0.5° C. Hot wall furnaces were initially designed as horizontal diffusion furnaces, however, more recently, vertical furnaces have gained favor because they present a number of advantages over their horizontal predecessors. These advantages include: elimination of cantilever or soft-landing since the wafers are held in a quartz boat which does not touch the process tube walls; wafers can be loaded and unloaded automatically; and, the clean room footprint of the system is somewhat smaller than that of the conventional horizontal configuration.

Vertical semiconductor furnaces of the type mentioned above employ a quartz tube which typically has a polysilicon coating when used for a deposition or annealing process. The polysilicon deposition reduces the power loss due to quartz reflection or radiation, and reduces the degradation of a boat occasioned by wet etching. Because semiconductor furnaces are subjected to high rates of usage and their components are exposed to harsh operating environments, periodic maintenance must be performed on various furnace components, including the external torch assembly for the furnace.

The formation of silicon oxide on a silicon substrate is a frequently conducted process in the fabrication of semiconductor devices. One of the methods for forming silicon oxide is thermal oxidization which is carried out by subjecting a silicon wafer to an oxidizing ambient at elevated temperatures. A common objective of an oxidizing system is to obtain a high quality silicon oxide film of uniform thickness while maintaining a low thermal budget (the product of temperature and time). Methods have been developed to increase the oxidation rate and to reduce the oxidation time and temperature. Two of such methods are the dry oxidation method and the wet oxidation method by using an external torch.

The substances used to grow thermal oxides on a silicon surface are dry oxygen and water vapor. In a dry oxygen reaction, silicon oxide is formed by $Si+O_2 \rightarrow SiO_2$, while for water vapor, the reaction is $Si+2H_2O \rightarrow SiO_2+2H_2$. In both cases, silicon is consumed and converted into silicon dioxide.

In a dry oxidation process, silicon dioxide layers can be formed in a temperature range of 400° C.~1150° C. The process is typically performed in a resistance-heated furnace or in a rapid thermal processing chamber with heat provided by tungsten halogen lamps. In a typical dry oxidation process, a horizontal furnace tube may be used in which a batch of wafers is introduced into the furnace tube positioned in a slow moving wafer boat and then heated to an oxidation temperature in a ramp-up process. The wafers are held at the elevated temperature for a specific length of time and then brought back to a low temperature in a ramp-down process. In the dry oxidation process, oxygen mixed with an inert carrier gas such as nitrogen is passed over the wafers that are held at an elevated temperature.

A wet oxidation process can be performed by either bubbling oxygen through a high purity water bath maintained at between 85° C. and 95° C., or by a direct reaction of hydrogen with oxygen producing water vapor in a pyrogenic steam oxidation process.

The thermal budget required to grow a silicon oxide layer to a certain thickness is considerably smaller in a wet oxidation process than that in a dry oxidation process. The wet oxidation process for producing a silicon oxide film can therefore be carried out more efficiently and at a lower cost. However, because of a residual water content, silicon oxide films formed by the wet oxidation process exhibit a lower dielectric strength and has higher porosity to impurity penetration than silicon oxide films formed in a dry oxidation process. As a compromise, wet oxidation process is frequently used in conjunction with dry oxidation process such that a high quality oxide film can be grown with minimized oxidation time required. This is performed by beginning and ending an oxidation process in dry oxygen while using the wet oxidation process for the intermediate stage which reduces the thermal budget while increasing the overall oxide growth rate. By using this dry oxidation-wet oxidation-dry oxidation process sequence, high quality silicon oxide films can be grown on both sides of the oxide layer in order to provide properties of the three-layered film comparable to those of a single layer grown by a dry oxidation process alone.

Another benefit of the wet oxidation process is that the apparatus used for carrying out the wet oxidation may also be used to carry out a dry oxidation process. For instance, as shown in FIG. 1, a wet oxidation apparatus 10 consists of an oxidation chamber 12, an external torch 14, and a conduit 16 that connects the external torch 14 and the oxidation chamber 12 for providing fluid communication therein between. The wet oxidation apparatus 10 further includes conduit 20 for feeding an inert gas into conduit 16 for purging both the conduit 16 and the oxidation chamber 12, conduit 22 for flowing oxygen into the external torch 14 by a carrier inert gas, and conduit 24 for flowing hydrogen into the external torch 14 with an inert carrier gas. An exhaust conduit 28 takes away unused or excess water vapor in the oxidation chamber 12. The flow of gases in conduits 20, 22 and 24 is controlled by valves 30, 32 and 34, respectively.

The convention wet oxidation apparatus 10 shown in FIG. 1 has been used for many years. In a normal silicon oxide growth process, in order to achieve high growth rates while minimizing the thermal budget of the process, the maximum $H_2/O_2$ gas mixture ratio of 1.8 is used for producing thick silicon oxide layers, i.e. layers thicker than 2000 Å. At the high $H_2/O_2$ gas mixture ratio of 1.8, the partial pressure of water vapor in the reaction chamber is very high which causes a loading effect, i.e., the lesser number of wafers are loaded in the reaction chamber, the poorer is the wafer-to-wafer coating uniformity.

In the conventional thick silicon oxide growth process carried out by the wet oxide method, the process is carried out by a single step pyrolysis technique at a high $H_2/O_2$ ratio of about 1.8. The gas mixture ratio of 1.8 for $H_2/O_2$ is the highest possible within a safety limit without the danger of causing an explosion in the furnace. After the gas mixture is burned in a torch, the high $H_2/O_2$ gas mixture ratio produces high water pressure in the furnace tube and thus achieves a high growth rate of silicon oxide. However, the excess water vapor left in the furnace tube does not stop reacting on the plurality of wafers positioned in the furnace until the water vapor is purged out by an inert gas.

The reaction mechanism in the wet oxidation process can be shown as follows:

$$2\,H_2O + Si \longrightarrow + SiO_2 + 2\,H_2. \quad \text{(The original reaction)}$$

$$2\,H_2 + O_2 \longrightarrow 2\,H_2O \quad \text{($H_2$ reacts with $O_2$ at high temperature in tube)}$$

$$2\,H_2O + Si \longrightarrow SiO_2 + 2\,H_2 \quad \text{(Secondary reaction occurs before $H_2O$ is purged out)}$$

The secondary reaction causes an effect known as the loading effect in which when the furnace tube is loaded only with a few wafer and that the wafers are charged from the top of the boat, the loading effect is very serious in the top than the bottom due to the different gas flow conditions leading to poor wafer-to-wafer uniformity.

The external torch 14 shown in FIG. 1 is a torch chamber for conducting the oxygen/hydrogen reaction for generating water vapor. The torch chamber is fabricated of a quartz material in order to withstand the high reaction temperature. After the torch chamber has been utilized for a time period, the chamber interior needs to be cleaned in order to prevent particle and contaminant formation. Conventionally, the torch chamber 18 is positioned in a cleaning bath 26 by supporting a bottom surface 38 on two support columns 40. The cleaning bath 26 is then filled with a cleaning solution 42 such that the entire torch chamber 18 is submerged in the cleaning solution 42. This is shown in FIG. 2. It should be noted that since FIG. 2 is a side view, the oxygen valve 32 and the hydrogen valve 34 are shown as a single valve. The support mechanism shown in FIG. 2 does not function well since when torch chamber 18 is accidentally moved, i.e. or rotated, the oxygen valve 32 may strike one of the support columns 40 resulting in a breakage of the chamber. Such breakage occurs frequently due to the fragile nature of the quartz material in the chamber. When oxygen valve 32 breaks off from the torch chamber 18, the entire torch chamber must be scrapped resulting in a costly replacement.

It is therefore an object of the present invention to provide an apparatus for cleaning a furnace torch that does not have the drawbacks or shortcomings of the conventional cleaning apparatus.

It is another object of the present invention to provide an apparatus for cleaning a furnace torch that utilizes a basket-shaped fixture for holding the torch.

It is a further object of the present invention to provide an apparatus for cleaning a furnace torch by utilizing a basket-shaped fixture for holding the torch such that it can be suspended in a cleaning bath.

It is another further object of the present invention to provide a method for cleaning a furnace torch by first providing a basket-shaped fixture for holding and suspending the torch in a cleaning bath such that gas inlet tubes on the torch are not damaged during the cleaning process.

SUMMARY OF THE INVENTION

In accordance with the present invention, an apparatus and a method for cleaning a furnace torch are disclosed.

In a preferred embodiment, an apparatus for cleaning a furnace torch is provided which includes a fixture body of generally cylindrical shape that has a top ring, a bottom ring and at least two support rods connecting the two rings together, the top ring is equipped with an outwardly extending flange portion adapted for engaging an opening in a cleaning bath for supporting and suspending the fixture body in the cleaning bath, the bottom ring is equipped with a pair of symmetrically positioned, inwardly extending, arcuate-shaped flange portions adapted for supporting an edge of a bottom surface of the furnace torch in the cleaning bath, the bottom ring has an opening defined by the pair of arcuate-shaped flange portions that is sufficiently large for allowing rotational motion of the furnace torch when suspended in the fixture body; and a cleaning bath of generally cylindrical shape that has an inside diameter sufficiently large for receiving the fixture body.

In the apparatus for cleaning a furnace torch, the fixture body may have a top ring, a bottom ring and three support rods connecting the top ring to the bottom ring. The fixture body may be constructed of stainless steel. The apparatus may further include a conduit for connecting to an outlet of the torch and for flowing a cleaning solution through an internal cavity of the torch. The cleaning bath may be filled with a cleaning solution for immersing the torch. The opening in the bottom ring may be sufficiently large so as to allow the penetration and rotation of at least one gas inlet attached to the bottom surface of the torch.

The present invention is further directed to a method for cleaning a furnace torch including the steps of providing a fixture body of generally cylindrical shape that has a top ring, a bottom ring and at least two support rods connecting the two rings together. The top ring is equipped with an outwardly extending flange portion adapted for engaging an opening in a cleaning bath for supporting and suspending the fixture body in the cleaning bath, the bottom ring may be equipped with a pair of symmetrically positioned, inwardly extending arcuate-shaped flange portions adapted for supporting an edge of a bottom surface of the furnace torch in the cleaning bath. The bottom ring may have an opening defined by the pair of arcuate-shaped flange portions that are sufficiently large for allowing a rotational motion of the furnace torch when suspended in the fixture body; providing a cleaning bath of generally cylindrical shape that has an inside diameter sufficiently large for receiving the fixture body; filling the cleaning bath with a cleaning solution; and positioning a furnace torch in the fixture body such that the torch is immersed in the cleaning solution.

The method for cleaning a furnace torch may further include the step of flowing the cleaning solution through an internal cavity of the torch, or the step of connecting a cleaning solution feed conduit to an outlet end of the furnace torch for flowing the cleaning solution through an internal cavity of the torch. The method may further include the step of filling the cleaning bath with a cleaning solution that includes an acid. The method may further include the step of filling the cleaning bath with a cleaning solution that includes a base. The method may further include the step of heating the cleaning bath such that the cleaning solution has a temperature of at least 50° C.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

Figure 1:
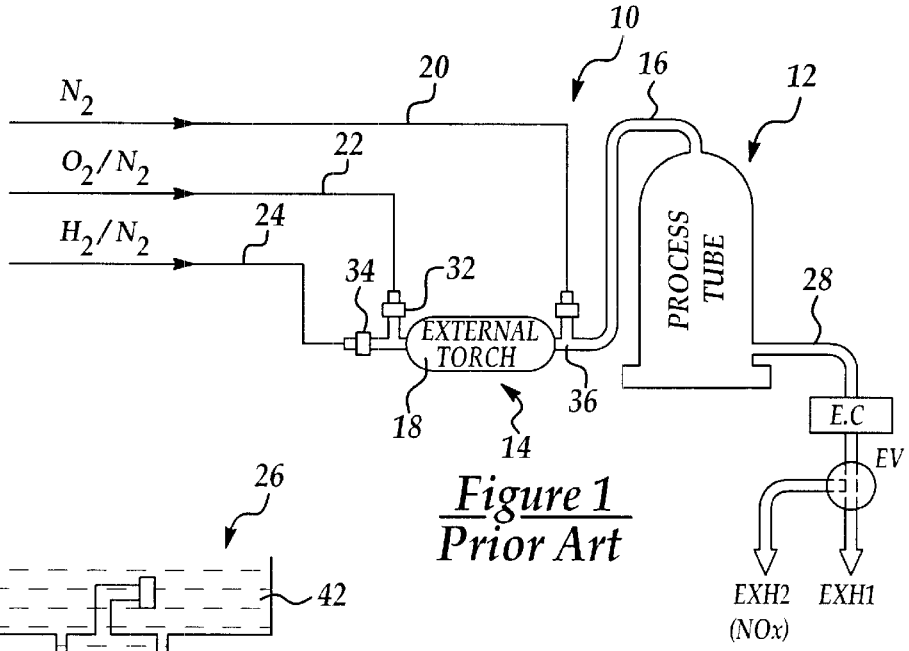
Figure 1 Prior Art
FIG. 1 is a graph illustrating a conventional vertical furnace system equipped with an external torch.
Figure 2:
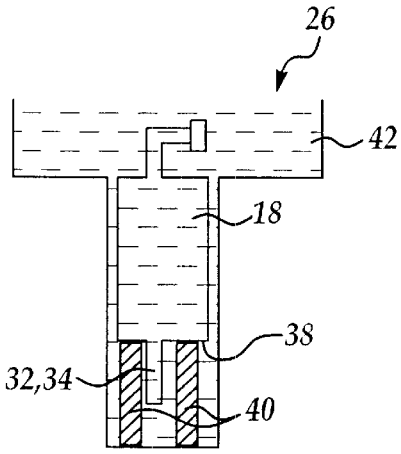
Figure 2 Prior Art
FIG. 2 is a graph illustrating a conventional method for cleaning the external torch by supporting the torch on support columns.

The present invention discloses an apparatus and a method for cleaning a furnace torch that is utilized in a vertical furnace system for semiconductor fabrication processes.

The apparatus can be constructed by two major components of a basket-shaped fixture and a cleaning bath. The basket-shaped fixture body is formed generally of cylindrical shape by a top ring, a bottom ring and at least two support rods connecting the rings together. The top ring is equipped with an outwardly extending flange portion fabricated of a teflon material and adapted for engaging an opening in a cleaning bath for supporting and suspending the fixture body in the cleaning bath. The bottom ring may similarly be equipped with a pair of symmetrically situated, inwardly extending arcuate-shaped flange portions adapted for supporting an edge of a bottom surface of the furnace torch suspended in the cleaning bath. The bottom ring has an opening defined by the pair of arcuate-shaped flange portions that is sufficiently large for allowing rotational motion of the furnace torch when suspended in the fixture body. The other major component of the cleaning bath is formed of a cylindrical shape with an inside diameter sufficiently large for receiving the fixture body. The basket-shaped fixture body may be constructed of stainless steel, except the outwardly extending flange portion which may be constructed of teflon. The opening in the bottom ring may be sufficiently large so as to allow the penetration and rotation of at least one gas inlet attached to the bottom surface of the torch.

The invention is further directed to a method for cleaning a furnace torch which can be carried out by first providing a basket-shaped fixture body such as one that is described above and a cleaning bath for receiving the fixture body. The method is then carried out by filling the cleaning bath with a cleaning solution and positioning a furnace torch in the fixture body such that the torch is suspended and immersed in the cleaning solution that may be acid based.

The present invention eliminates the drawbacks of the conventional cleaning apparatus in which the torch may be broken when it is accidentally rotated leading to the breakage of gas inlet tubes attached to the bottom of the torch. The present invention utilizes a novel basket-shaped fixture for holding and suspending the torch in a cleaning solution such that even when the torch is accidentally rotated, the gas inlet tubes at the bottom of the torch are not damaged. Based on the design of the present invention novel apparatus, the opening provided in the basket-shaped fixture allows plenty of room for the torch to be rotated without colliding with the cleaning fixture. A bottom opening of the basket-shaped fixture produces a large clearance with the furnace torch when the torch is mounted into the opening. On top of the basket, a wide flange is provided for engaging a shoulder portion of a cleaning bath such that the torch can be suspended in the basket-shaped fixture.

Figure 3:
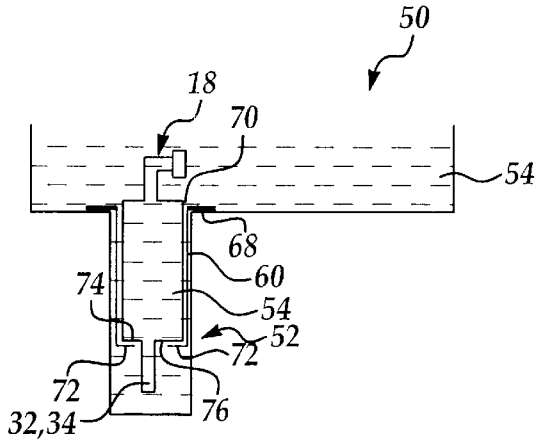
FIG. 3 is a graph illustrating the present invention method for cleaning a furnace torch by suspending the torch in a cleaning bath by a basket-like fixture.

Referring now to FIG. 3, wherein a present invention cleaning apparatus 50 is shown. The cleaning apparatus 50 consists of a cleaning bath 52, into which a cleaning solution 54 is filled. The furnace torch 18 is suspended in a basket-shaped fixture 60, which is shown in FIG. 4 in a perspective view.

Figure 4:
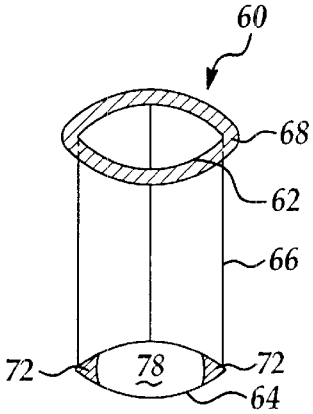
FIG. 4 is a perspective view of the present invention basket-like fixture for suspending the furnace torch during the cleaning process.

As shown in FIG. 4, the basket-shaped fixture 60 is constructed by a top ring 62, a bottom ring 64 and at least three support rods 66 that connect the top ring 62 and the bottom ring 64 together. In the preferred embodiment shown in FIG. 4, three support rods 66 are provided. The basket-shaped fixture 60 is generally formed in a cylindrical shape such that a cylindrical shaped furnace torch 18 can slide therein. The top ring 62 is further provided with an outwardly extending flange portion 68 that is adapted for engaging an opening 70 of the cleaning bath 52. The bottom ring 64 is equipped with a pair of symmetrically positioned, inwardly extending arcuate-shaped flange portions 72 adapted for supporting an edge 74 of a bottom surface 76 of the furnace torch 18. The bottom ring 64 defines an opening 78 by the pair of arcuate-shaped flange portions 72. The opening 78 is sufficiently large for allowing rotational motion of the furnace torch 18 when the torch is suspended in the fixture body 60. It should be noted that since FIG. 3 is shown in a cross-sectional view with the furnace torch 18 positioned sideways, the oxygen inlet valve 32 and the hydrogen inlet valve 34 are shown overlapped together.

The basket-shaped fixture body 60 may be fabricated of stainless steel, while the flange portion 68 may be fabricated of teflon for easy engagement with the cleaning bath and for chemical resistance.

The present invention apparatus for cleaning a torch used in a vertical furnace for semiconductor processing and a method for utilizing the apparatus have therefore been amply described in the above description and in the appended drawings of FIGS. 3 and 4.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows.

What is claimed is:

1. An apparatus for cleaning a furnace torch of semiconductor processing device comprising:

a fixture body of generally cylindrical shape having a top ring, a bottom ring and at least two support rods connecting the two rings together; and a cleaning bath of generally cylindrical shape having an inside diameter sufficiently large for receiving said fixture body, wherein said bottom ring being equipped with a pair of symmetrically positioned, inwardly extending arcuate-shaped flange portions adapted for supporting an edge of a bottom surface of said furnace torch in said cleaning bath.

2. An apparatus for cleaning a furnace torch according to claim 1, wherein said top ring being equipped with an outwardly extending flange portion adapted for engaging an opening in a cleaning bath for supporting and suspending said fixture body in said cleaning bath, and, said bottom ring having an opening defined by said pair of arcuate-shaped flange portions that is sufficiently large for allowing rotational motion of said furnace torch when suspended in said fixture body.

3. An apparatus for cleaning furnace torch according to claim 1, wherein said fixture body having top ring, bottom ring and three support rods connecting said top ring to said bottom ring.

4. An apparatus for cleaning a furnace torch according to claim 1, wherein said fixture body being constructed of stainless steel.

5. An apparatus for cleaning a furnace torch according to claim 1 further comprising a conduit for connecting to an outlet of said torch and for flowing a cleaning solution through an internal cavity of said torch.

6. An apparatus for cleaning a furnace torch according to claim 1, wherein said cleaning bath being filled with a cleaning solution for immersing said torch.

7. An apparatus for cleaning a furnace torch according to claim 2, wherein said opening in said bottom ring being sufficiently large so as to allow the penetration and rotation of at least one gas inlet attached to said bottom surface of the torch.

8. A method for cleaning a furnace torch of semiconductor processing device comprising the steps of:

providing a fixture body of generally cylindrical shape having a top ring, a bottom ring, wherein said bottom ring includes a pair of symmetrically positioned, inwardly extending arcuate-shaped flange portions adapted for supporting an edge of a bottom surface of said furnace torch and at least two support rods connecting the two rings together;

providing a cleaning bath of generally cylindrical shape having an inside diameter sufficiently large for receiving said fixture body;

filling said cleaning bath with a cleaning solution; and positioning the furnace torch in said fixture body such that the torch is immersed in said cleaning solution; and rotating the torch.

9. A method for cleaning a furnace torch according to claim 8 further comprising the step of providing said top ring with an outwardly extending flange portion adapted for engaging an opening in a cleaning bath for supporting and suspending said fixture body in said cleaning bath, providing said bottom ring with an opening defined by said pair of arcuate-shaped flange portions that is sufficiently large for allowing a rotational motion of said furnace torch when suspended in said fixture body.

10. A method for cleaning a furnace torch according to claim 8 further comprising the step of flowing said cleaning solution through an internal cavity of said torch.

11. A method for cleaning a furnace torch according to claim 8 further comprising the step of connecting a cleaning solution feed conduit to an outlet end of said furnace torch for flowing said cleaning solution through an internal cavity of the torch.

12. A method for cleaning a furnace torch according to claim 8 further comprising the step of filling said cleaning bath with a cleaning solution that comprises an acid.

13. A method for cleaning a furnace torch according to claim 8 further comprising the step of heating aid cleaning bath such that said cleaning solution has a temperature of at least 50° C.

* * * * *